United States Patent [19]

Copp, Jr.

[11] Patent Number: 5,067,656

[45] Date of Patent: Nov. 26, 1991

[54] AIR VOLUME BOOSTER FOR SPRAYERS

[76] Inventor: William H. Copp, Jr., 34-2 Sullivan Rd., North Billerica, Mass. 01862

[21] Appl. No.: 493,531

[22] Filed: Mar. 15, 1990

[51] Int. Cl.[5] ..... B05B 1/28; F04B 23/00

[52] U.S. Cl. ..... 239/290; 417/87

[58] Field of Search ..... 417/87; 239/290, 300

[56] References Cited

U.S. PATENT DOCUMENTS

| | | | |
|---|---|---|---|
| 4,352,637 | 10/1982 | Weisenbach | 417/87 X |
| 4,565,488 | 1/1986 | Muck | 415/121.2 X |
| 4,850,809 | 7/1989 | Smith | 239/354 X |
| 4,854,822 | 8/1989 | Darroch | 417/62 |
| 4,869,641 | 9/1989 | Hufgard | 417/368 X |
| 4,911,365 | 3/1990 | Thiel et al. | 239/300 X |
| 4,991,776 | 2/1991 | Smith | 239/290 |

*Primary Examiner*—Andres Kashnikow
*Assistant Examiner*—William Grant
*Attorney, Agent, or Firm*—Ernest Kettelson

[57] ABSTRACT

An air volume booster for sprayers which have a turbine, which when connected to a compressed air source, provide a high volume, low pressure output to a spray gun connected to the sprayer. The booster comprises a supercharger having a shallow cylindrical chamber mounted to the sprayer below the turbine chamber at the intake side thereof, and two inlet ports, one of which is connected to a compressor which provides a source of pressurized air, the other opening to the ambient air. The first inlet port has a venturi incorporated therein and connected to the pressurized air source, which increases the volume of air fed into the supercharger chamber and in turn into the turbine through its intake side for delivery of a substantially increased volume of air at low pressure from the output side of the turbine directed to the spray gun connected thereto.

10 Claims, 7 Drawing Sheets

AIR VOLUME BOOSTER FOR SPRAYERS

BACKGROUND OF THE INVENTION

This invention relates to devices for increasing the volume of pressurized air delivered to sprayers. In particular it relates to a booster which increases the volume of pressurized air to a sprayer which utilizes a turbine to provide a volume of low pressure air delivered to the spray gun.

Prior art devices of this general type which are known to the inventor are described in the following United States patents.

U.S. Pat. No. 4,850,809 discloses a fluid atomizing sprayer in which a venturi converts high pressure, low volume air to low pressure, high volume air at its output side. The sprayer disclosed in this patent does not utilize a turbine, nor any electrically powered appliance at all in the spray generating part of the equipment remote from the power mechanism which provides the original source of compressed air.

U.S. Pat. No. 4,565,488 discloses a centrifugal type compressor in which a portion of the pressurized output air is channeled back to the intake side to reduce the pressure differential between the intake and output sides of the compressor thereby reducing forces acting on the internal parts of the compressor.

U.S. Pat. No. 4,048,798 discloses a rotary type engine in which the turbine is separated from the combustion chamber, and pressurized gases are fed from the combustion chamber to the turbine through a conduit which includes a venturi.

U.S. Pat. No. 726,770 discloses a steam operated motor in which a venturi type injector is connected between the steam boiler and the motor. The injector draws ambient air into the line through the venturi, to increase fluid velocity and volume while at the same time reducing pressure.

Sprayers which utilize a turbine to increase air volume and lower pressure are also known to the prior art. The invention described and claimed herein comprises an improvement for such sprayers by providing a supercharger that substantially boosts or increases the volume of air such sprayers are able to deliver at lower pressure. Increasing the volume of air at lower pressure enables sprayers to do a better job of applying paint to the surfaces being painted, and gives the workman better control over the quality of his work.

The supercharger also performs the function of cooling the pressurized air delivered to the turbine by increasing the volume thereof and lowering its pressure as air is flowed through the venturi into the chamber of the supercharger.

SUMMARY OF THE INVENTION

It is an object of the invention to provide a sprayer having a booster to increase the volume of pressurized air delivered to the sprayer.

It is an object of the invention to provide a booster to increase the volume of pressurized air to the intake side of the turbine of sprayers which utilize such turbine to itself convert high pressure low volume air from a compressed air source to high volume, low pressure output from the sprayer.

It is an object of the invention to provide a booster to increase the volume of pressurized air to the intake side of the turbine of a sprayer, in which the booster comprises a supercharger having a shallow cylindrical chamber mounted at the intake side of the turbine and opening thereto, a source of pressurized air connected to an inlet port opening to the chamber of the supercharger in which the inlet port includes a venturi that increases the volume of air delivered into the supercharger chamber and in turn into the turbine chamber for delivery of an increased amount of high volume, low pressure air at the output of the sprayer.

It is an object of the invention to provide a booster for a sprayer having a turbine to increase the volume of pressurized air at lower pressure, comprising a supercharger which cools the air delivered to the turbine in addition to increasing the volume and lowering the pressure thereof.

DESCRIPTION OF PREFERRED EMBODIMENT

Figure 1:
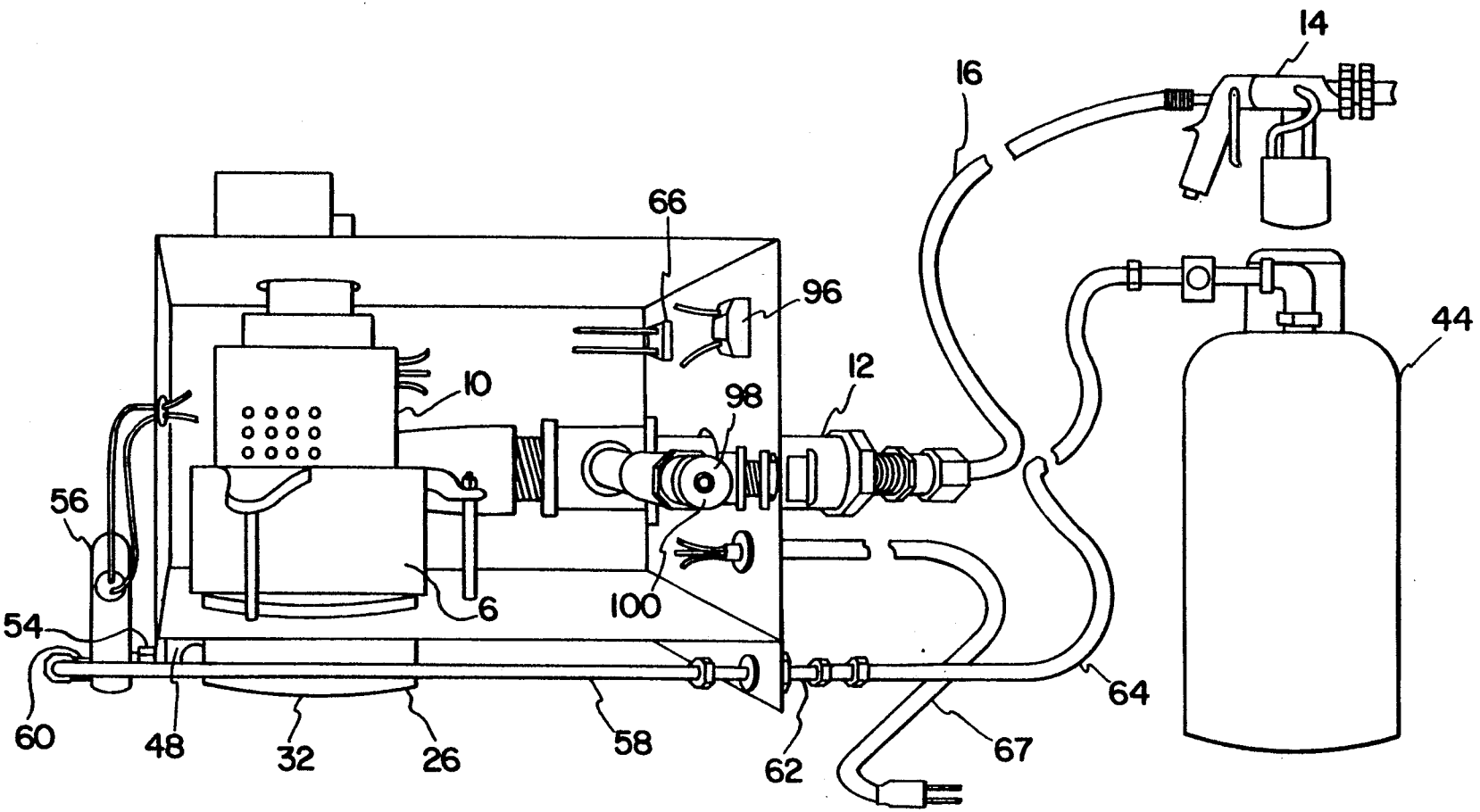
FIG. 1 is a perspective view of a sprayer having an air volume booster in accordance with this invention.
Figure 2:
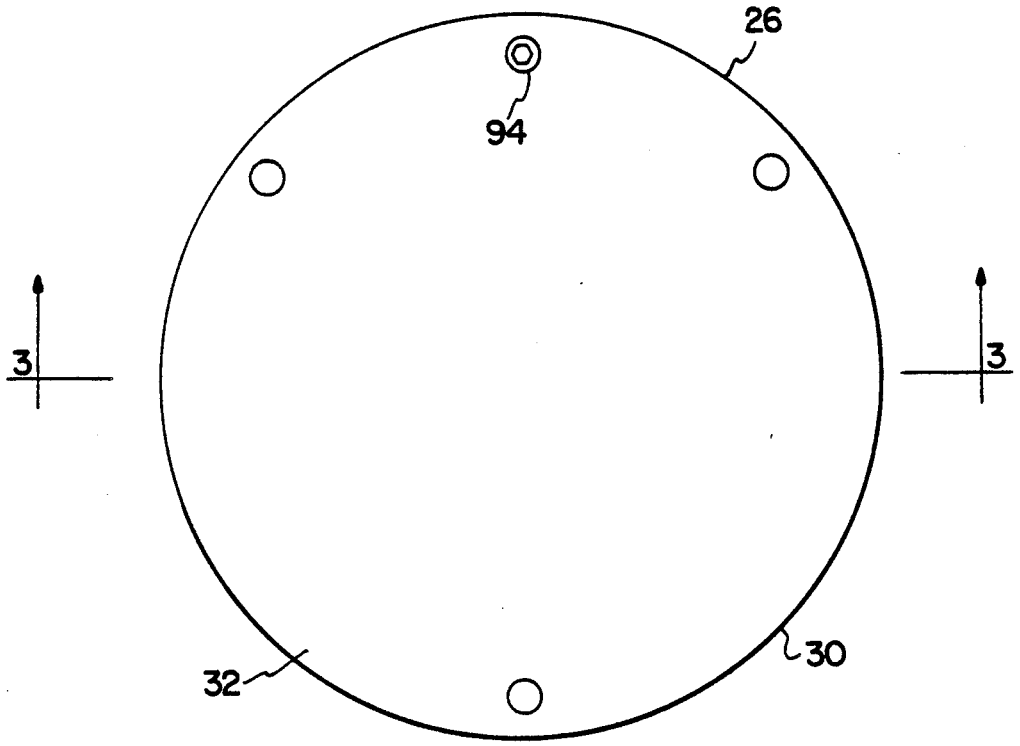
FIG. 2 is a plan view from the bottom of the supercharger housing detached from the turbine housing, and with the venturi member and other air intake coupling member removed.
Figure 3:
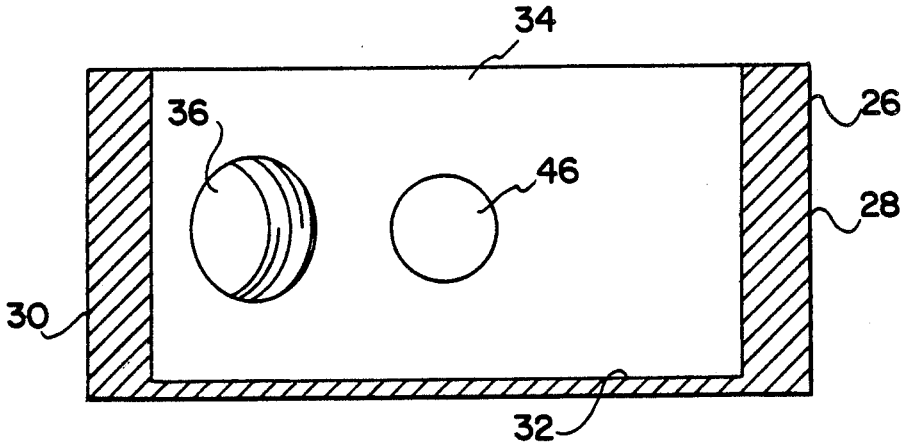
FIG. 3 is a sectional view taken on line 3—3 of FIG. 2 showing the internal chamber of the supercharger housing having two apertures for connection of the venturi member in one and the other air intake coupling member in the second.
Figure 4:
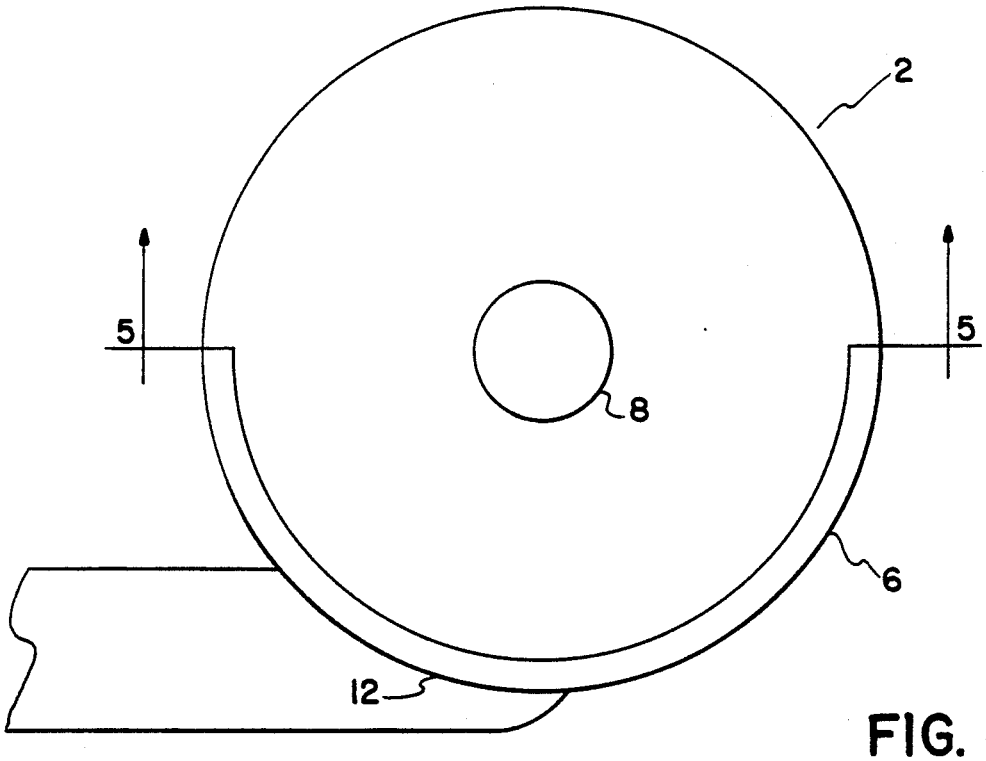
FIG. 4 is a top plan view of the turbine housing.
Figure 5:
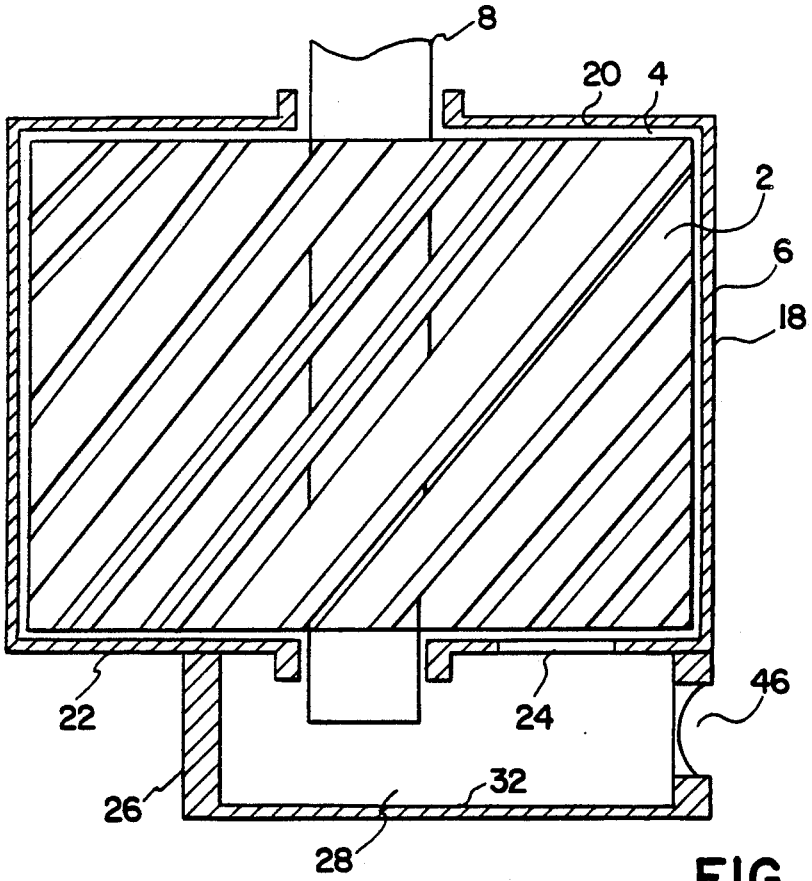
FIG. 5 is a section view taken on line 5—5 of FIG. 4 showing a section view of the turbine housing and a side elevation view of the turbine being visible through the broken away portion of the turbine housing wall; a section view of the supercharger housing is also shown with the supercharger chamber connected to the bottom side of the turbine housing.
Figure 6:
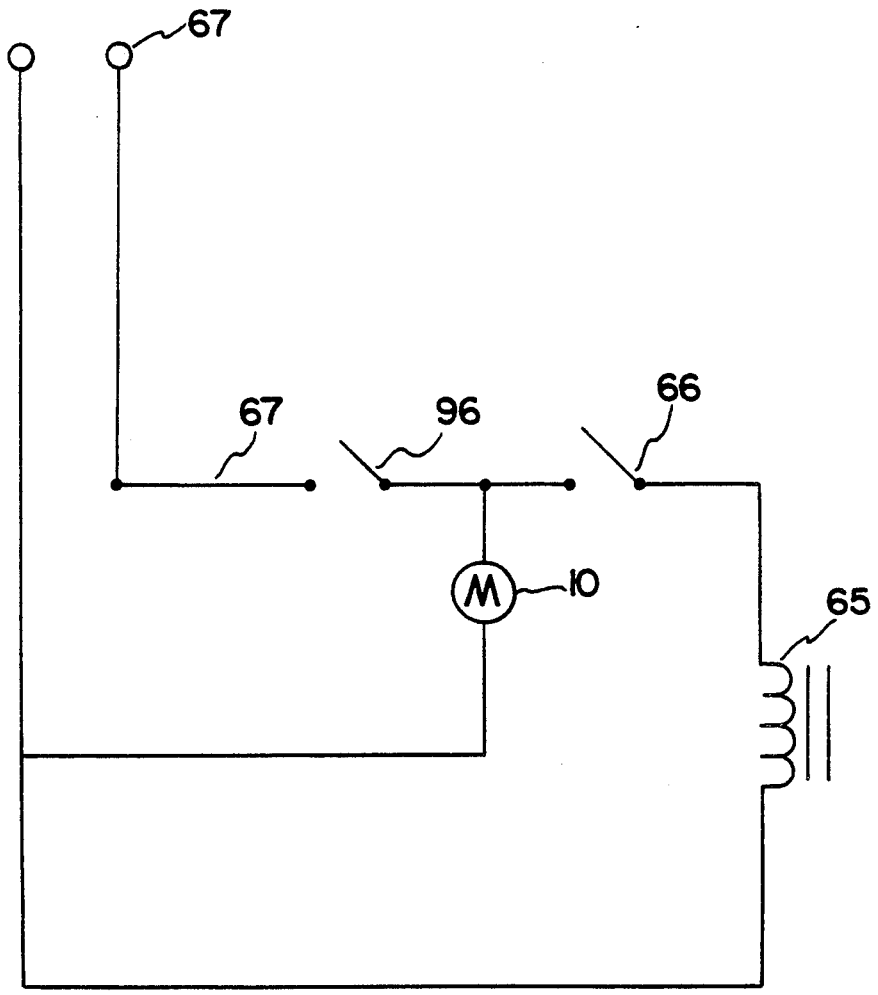
FIG. 6 is a schematic showing the operating circuit in accordance with this invention.
Figure 7:
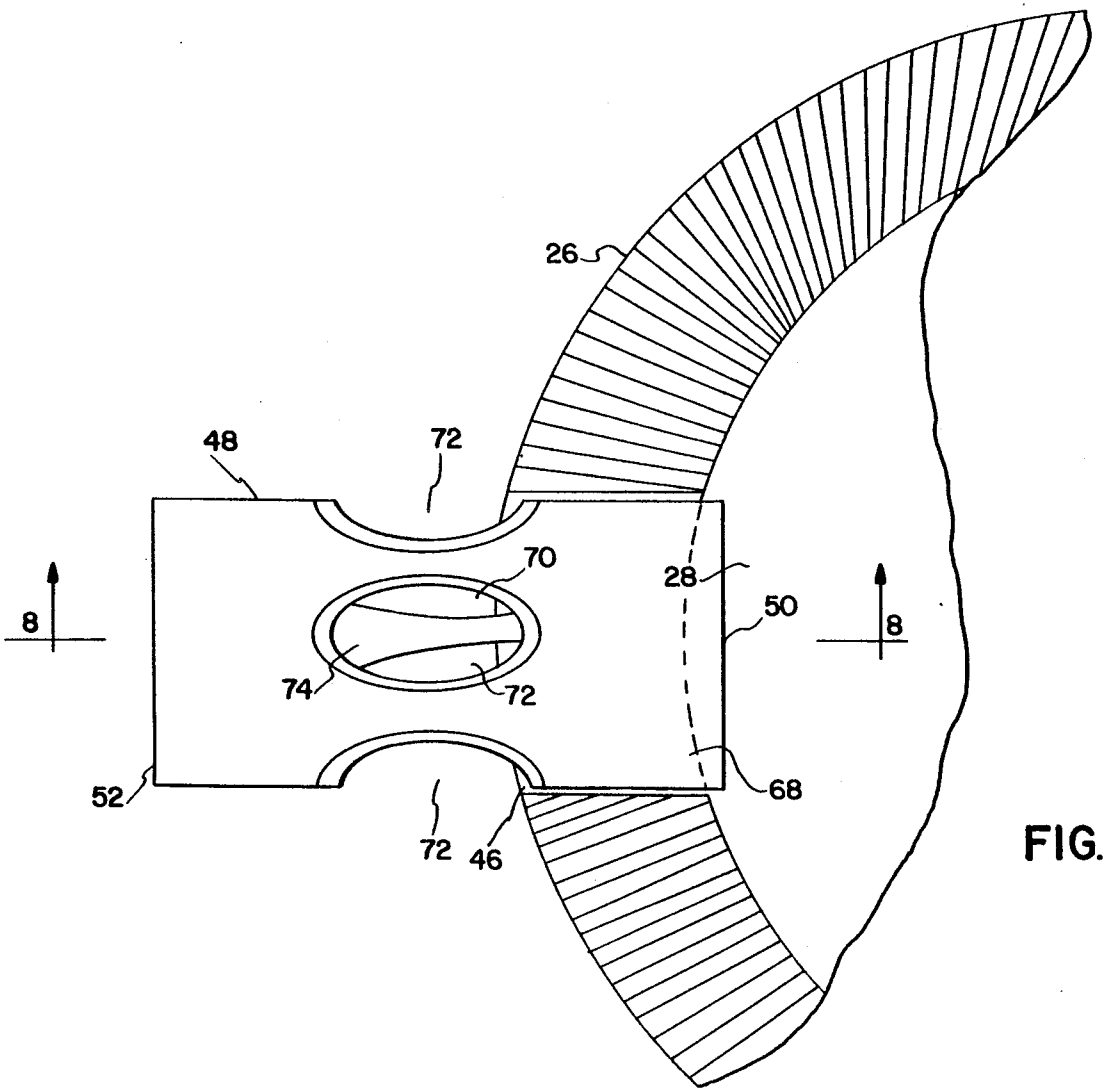
FIG. 7 is a side elevation view of a venturi member inserted in the chamber of the supercharger housing, the lower half of the supercharger housing being shown in section.
Figure 8:
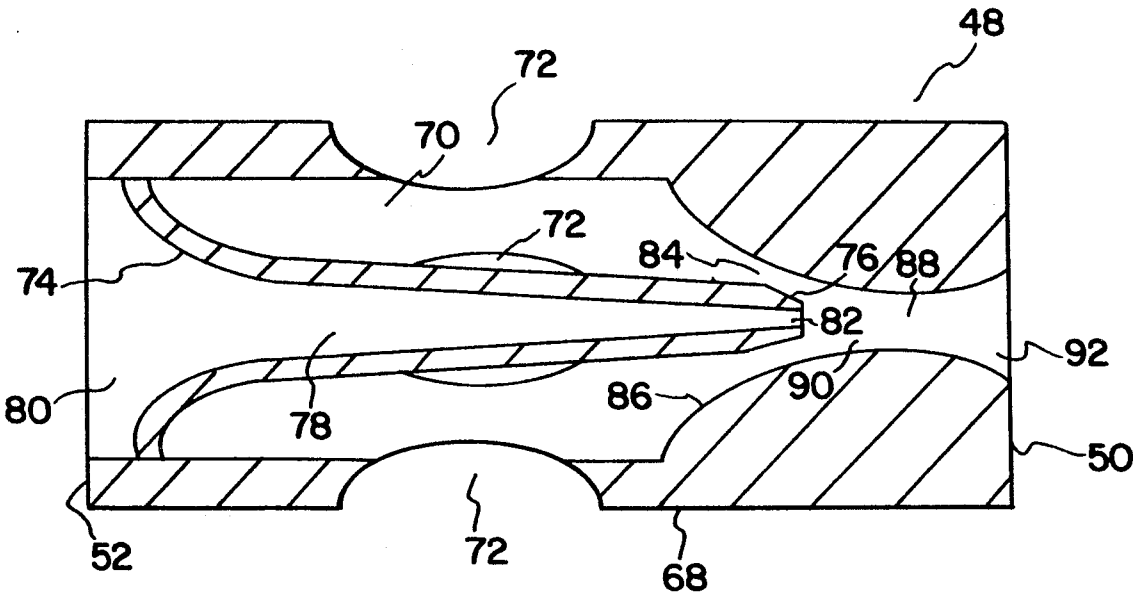
FIG. 8 is a sectional view taken on line 8—8 of FIG. 7 showing the internal chamber of the venturi, the nozzle extending therein, and the venturi throat at the discharge end of the venturi member.
Figure 9:
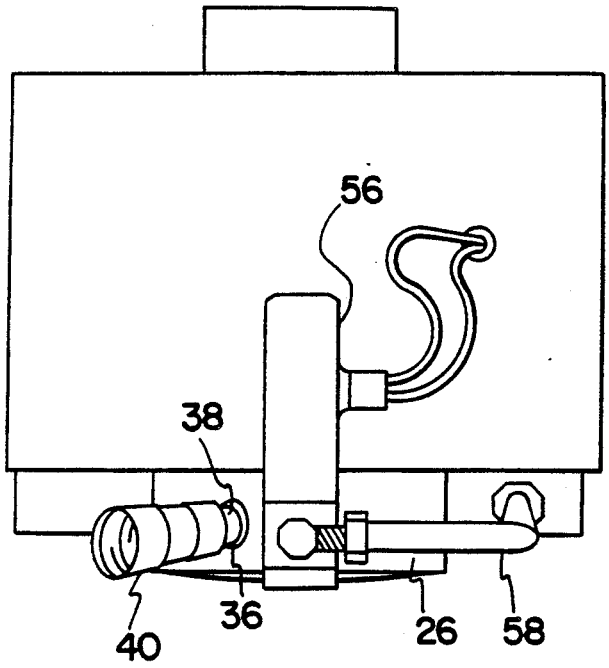
FIG. 9 is a rear elevation view of the sprayer having an air volume booster in accordance with this invention.

A sprayer in accordance with this invention includes a turbine 2 rotatably mounted in a turbine chamber 4 of a turbine housing 6 connected by a drive shaft 8 to an electric motor 10.

An outlet port 12 leads from the output side of turbine chamber 4 for connection of a spray gun 14 thereto by a flexible hose 16.

The turbine housing 6 includes a cylindrical side wall 18, a top wall 20, and a bottom wall 22 having an intake aperture 24 therein opening to the turbine chamber 4 for delivery of pressurized air to the intake side of the turbine 2.

A supercharger 26 is mounted adjacent the bottom wall 22 of the turbine housing 6. The supercharger 26 has a cylindrical supercharger chamber 28 bounded by a cylindrical side wall 30, a bottom wall 32, and an open top wall 34 facing and opening to the aperture 24 leading to the turtine 2 in the turbine chamber 4.

A first inlet port 36 opens to the supercharger chamber 28, having a threaded conduit connector 38 secured therein at one end and a check valve 40 threaded on the opposite end of connector 38. Ambient air is drawn into the supercharger chamber 28 and turbine housing 6 through this inlet port 36.

A second inlet port 46 also opens to the supercharger chamber 28, having a venturi member 48 extending therein. The inwardly extending discharge end 50 of the venturi member 48 extends past the inlet port 46 and terminates inwardly of the supercharger chamber 28. The outwardly extending coupling end 52 of the venturi member 48 extends outwardly of the inlet port 46 and terminates in an internally threaded aperture having a conduit connector 54 threaded therein.

A cut-off valve assembly 56 is connected to the connector 54 on one side, the outlet side of valve assembly 56, and to an air inlet line 58 on the inlet side 60 thereof. The air inlet line 58 terminates at a conduit connector 62, one end of which is connected to the air inlet line 58 and its opposite end is connected to air hose 64 leading to an air compressor 44.

The cut-off valve 56 includes a solenoid 65 movable between a valve open and valve closed position connected in the electrical operating circuit 67 and controlled by an on-off switch 66 to energize the solenoid 65 when in the switch closed position and de-energize when in the switch open position.

The cut-off valve 56 is provided to close the air passage to the supercharger chamber 28 through the venturi member 48 when it is desired to by-pass the venturi member 48 and draw ambient air into the supercharger chamber 28 and in turn to the turbine chamber 4 and turbine 2 through the first inlet port 36.

For certain spraying operations, it is not necessary to have the increased volume of air provided by flowing pressurized air through the venturi member 48.

The venturi member 48 includes a cylindrical housing 68 surrounding the venturi chamber 70 opening to the supercharger chamber 28 at discharge end 50 and to the passageway of conduit connector 54 at coupling end 52 of the venturi member 48.

The cylindrical housing 68 surrounding venturi chamber 70 includes four apertures 72 spaced apart radially around and through the cylindrical side wall of housing 68 opening to the venturi chamber 70 at a point up-stream from the discharge end 50 of the venturi member 48.

A nozzle 74 is provided within the venturi chamber 70, extending co-axially therewith having a smaller diameter than venturi chamber 70. The nozzle 74 is substantially cylindrical in cross-section but tapers as it approaches its discharge end 76. The nozzle 74 has a cylindrical passageway 78 therethrough, opening at its upstream end 80 to the passageway of conduit connector 54 to receive pressurized air therethrough from the air compressor 44. The cylindrical passageway 78 tapers and narrows as it approaches the discharge end 76, opening at discharge end 76 of the nozzle 74 in a narrowed discharge aperture 82.

The venturi chamber 70 of venturi member 48 has a venturi throat 84 therein extending from its discharge end 50 in an upstream direction, the venturi throat 84 terminating in a flared upstream end 86, and having a passageway 88 therethrough extending from an outwardly flared mouth 90 at its upstream end positioned in registration with the discharge end 76 of nozzle 74, to the throat outlet aperture 92 at the discharge end 50 of the venturi member 48.

The narrowed discharge aperture 82 of nozzle 74 opens at the entrance to the outwardly flared mouth 90 of the venturi throat 84, co-axial with throat passageway 88. The discharge aperture 82 of nozzle 74 opens at the entrance to the outwardly flared mouth 90 of venturi throat 84 at a point downstream from the four apertures 72 through the cylindrical housing 68, which open to the venturi chamber 70 upstream from the nozzle discharge aperture 82.

The venturi member 48 is held in place in the second inlet port 46 of supercharger chamber 28 by a set screw 94. It is positioned in the inlet port 46 so that the four apertures 72 through the side wall of the venturi housing 68 are substantially outside of the supercharger chamber 28 for exposure to the ambient air and intake thereof during operation.

A motor control switch 96 is provided to energize and de-energize the motor 10 in electrical circuit 60 for operation of the turbine 2.

In operation, the motor control switch 96 is moved to the switch closed position to energize the electric motor 10 to rotate the turbine 2. If the sprayer is to operate without the increased volume of air provided by the supercharger 26, the on-off switch 66 which controls operation of the solenoid 65 in the cut-off valve assembly 56 is switched to the position which moves the solenoid 65 to the valve closed position. If the sprayer is to be operated with the increased volume of air provided by the supercharger 26, switch 66 is switched to the opposite position which moves the solenoid 65 to the valve open position, which permits pressurized air to flow from the compressor 44 through air inlet line 58, the open valve assembly 56, and through the venturi member 48 into the supercharger chamber 28.

As pressurized air flows through the venturi member 48 and its nozzle 74, its restricted or narrowed discharge aperture 82 opening to the outwardly flared venturi throat 84 causes the velocity of the pressurized air to increase and its pressure to drop. Such venturi action creates a partial vacuum in the venturi chamber 70 which draws an increased volume of air into the venturi chamber 70 through the four apertures 72 of the cylindrical venturi housing 68. Such increased volume of air is drawn by the vacuum created by the venturi action into the throat 84 of the venturi member 48 and through its discharge end 50 into the supercharger chamber 28.

The increased volume of air drawn into the venturi member 48 through the four apertures 72 is ambient air at its relatively low atmospheric pressure. The increased volume of air discharged from the venturi member 48 into the supercharger chamber 28, together with the pressurized air flowed through the venturi nozzle 74 which itself has its pressure lowered as it flows through the restricted nozzle aperture 82, is therefore not only increased in volume but lowered in pressure relative to that of the pressurized air as it leaves the compressor 44.

Such increased volume, lowered pressure air delivered to the supercharger chamber 28 is drawn into the turbine chamber 4 by the vacuum created at its intake aperture 24 by rotation of the vanes of the turbine 2. Rotation of the turbine 2 in itself increases the volume of the air as it is discharged from the turbine chamber 4 through its outlet port 12, flexible air hose 16 and spray gun 14.

Thus, the sprayer in accordance with this invention provides a substantially increased volume of air to the spray gun 14 when pressurized air is flowed through the second air hose 64 and venturi member 48 into the supercharger chamber 28 and turbine chamber 4.

When pressurized air is flowed from the compressor 44 through the venturi member 48 into the supercharger charger 28 and turbine chamber 4, and combined with the increase in volume provided by operation of the turbine 2, the air output at outlet port 12 of the turbine chamber 4 is increased in volume about three times as compared to when air from the compressor 44 is not flowed through the venturi member 48 but only ambient air is drawn through check valve 40 and inlet port 36 directly into the supercharger chamber 28 and turbine chamber 4.

The venturi member 48 in accordance with this invention when connected to the supercharger chamber 28 as described, increases the volume of air fed into the supercharger chamber 28 and turbine chamber 4 from the compressor 44 from about ten cubic feet per minute to about forty cubic feet per minute.

The increased volume of air flowed into the supercharger chamber 28 through the venturi member 48 also serves to substantially cool the turbine 2 as it is drawn into the turbine chamber 4. Thus, this invention not only provides an output of substantially increased volume of air but it also provides a cooling mechanism for the turbine and its operating parts as well.

The outlet port 12 leading from the output side of turbine chamber 4 has a relief valve 98 connected thereto which protects the turbine when flow of air through the spray gun 14 is shut off. The closure cap 100 of relief valve 98 is normally biased to its valve closed position, but is forced to its valve open position when air pressure builds up in the outlet port or conduit 12 to the selected cut off point to relieve back pressure on the turbine while it is still rotating and the flow of air through the spray gun 14 remains shut off.

I claim:

1. An air supply system to provide a high volume of air at relatively low pressure having an air intake and an air outlet and a booster assembly to increase the volume of said relatively low pressure air at its said outlet, comprising first pressurized air supply means to provide a first supply of relatively low pressure air positioned between the said outlet and said intake of said air supply system, second pressurized air supply means comprising an air pressurizer and said booster assembly to provide a second supply of relatively low pressure air positioned between the said outlet and said intake of said air supply system, said booster assembly including volume-increasing-pressure-decreasing means to take in ambient air at atmospheric pressure while it takes in air at above atmospheric pressure from said air pressurizer to thereby increase the volume of air supplied by said booster assembly above that from said air pressurizer and lower the pressure of air supplied by said booster assembly below that from said air pressurizer, and coupling means to couple said first and second pressurizer air supply means together whereby the air discharged at said outlet is increased in volume to an extent greater than that provided by either said first pressurized air supply means or said second pressurized air supply means individually.

2. An air supply system as set forth in claim 1, wherein said first pressurized air supply means includes a turbine housing having a turbine chamber therein, a turbine mounted for rotation in said turbine chamber, drive means to rotate said turbine, a turbine chamber intake to flow pressurized air into said turbine chamber, and a turbine chamber outlet to flow air out of said turbine chamber.

3. An air supply system as set forth in claim 1, wherein said volume-increasing-pressure-decreasing means includes a supplemental housing having an unobstructed supplemental chamber therein, a venturi member having a discharge end opening to said unobstructed supplemental chamber and an opposite outwardly extending end projecting outwardly from said unobstructed supplemental chamber, said venturi member having a peripheral wall extending between said ends thereof encompassing a venturi chamber, nozzle means in said venturi chamber having a through passage opening at an outer end adjacent said outwardly extending end of said venturi member and in a narrowed aperture at its opposite inner end, throat means in said venturi chamber having an outwardly flared mouth positioned in line with said narrowed aperture at said inner end of said nozzle means, said throat means extending from said outwardly flared mouth to said discharge end of said venturi member and opening to said unobstructed supplemental chamber, said venturi member having aperture means through its said peripheral wall upstream from said narrowed aperture at said inner end of said nozzle means, said supplemental housing having a supplemental chamber outlet to flow air out of said unobstructed supplemental chamber, said outwardly extending end of said venturi member being connectable to said air pressurizer of said second pressurized air supply means.

4. An air supply system as set forth in claim 3, wherein said first pressurized air supply means includes a turbine housing having a turbine chamber therein, a turbine mounted for rotation in said turbine chamber, drive means to rotate said turbine, a turbine chamber intake to flow air into said turbine chamber, a turbine chamber outlet to flow air out of said turbine chamber, said coupling means includes a connecting member to connect said turbine chamber intake to said supplemental chamber outlet to flow said second supply of low pressure air from said unobstructed supplemental chamber into said turbine chamber.

5. An air supply system as set forth in claim 4, wherein said unobstructed supplemental chamber includes a separate air inlet port for drawing ambient air therein, a cut-off valve operable between a valve open and a valve closed position connected to said venturi member to shut off flow of pressurized air to said venturi member when in said valve closed position, whereby only ambient air is drawn into said unobstructed supplemental chamber and said turbine chamber through said separate air inlet port when said cut-off valve is in its said valve closed position.

6. An air supply system as set forth in claim 4, wherein said supplemental housing comprises a cylindrical supercharger housing in which said unobstructed supplemental chamber to receive an increased volume of cool air through said venturi member is cylindrical, for flowing said volume of cool air from said cylindrical supplemental chamber to said turbine chamber and said turbine for cooling thereof.

7. An air supply system as set forth in claim 4, wherein said drive means to rotate said turbine comprises an electric motor.

8. An air supply system as set forth in claim 5, wherein said cut-off valve comprises an electrically operated solenoid valve.

9. An air supply system as set forth in claim 6, wherein said air pressurizer of said second pressurized air supply means includes a compressor to provide a said source of pressurized air, said venturi member being connected to said compressor to receive a supply of said pressurized air therethrough and into said cylindrical chamber of said supercharger housing from said compressor.

10. An air supply system as set forth in claim 1, including an elongated air hose having a first end connected to said outlet of said air supply system and an opposite second end, a spray gun connected to said second end of said elongated air hose to receive said air discharged from said outlet of said air supply system.

* * * * *